United States Patent [19]

Kramer et al.

[11] Patent Number: 4,803,928

[45] Date of Patent: Feb. 14, 1989

[54] TANDEM CHARGE PROJECTILE

[76] Inventors: Stefan Kramer, Schlott 18, 8899 Hohenwart; Georg Aschenbrenner, Sankt Sebastian-Str. 15, 8898 Schrobenhausn, both of Fed. Rep. of Germany

[21] Appl. No.: 76,148

[22] Filed: Jul. 21, 1987

[30] Foreign Application Priority Data

Aug. 2, 1986 [DE] Fed. Rep. of Germany ..... 3626305

[51] Int. Cl.[4] ..... F42B 13/12

[52] U.S. Cl. ..... 102/476; 102/306; 102/397; 102/500

[58] Field of Search ..... 102/476, 473, 306–310, 102/396, 397, 499, 500

[56] References Cited

U.S. PATENT DOCUMENTS 2,946,283 7/1960 Udry ..... 102/306
4,063,512 12/1977 Davis ..... 102/476

FOREIGN PATENT DOCUMENTS 1811331 6/1970 Fed. Rep. of Germany .
2757806 7/1978 Fed. Rep. of Germany .
3137198 4/1983 Fed. Rep. of Germany ..... 102/397

*Primary Examiner*—Harold J. Tudor

[57] ABSTRACT

A projectile with a tandem charge consisting of a borehole charge and a secondary firing charge, in which exact piercing guidance between the borehole charge and the secondary firing charge is obtained by the counterdirectional motion of the housing part with the secondary firing charge relative to a tubular guiding part of the housing.

2 Claims, 1 Drawing Sheet

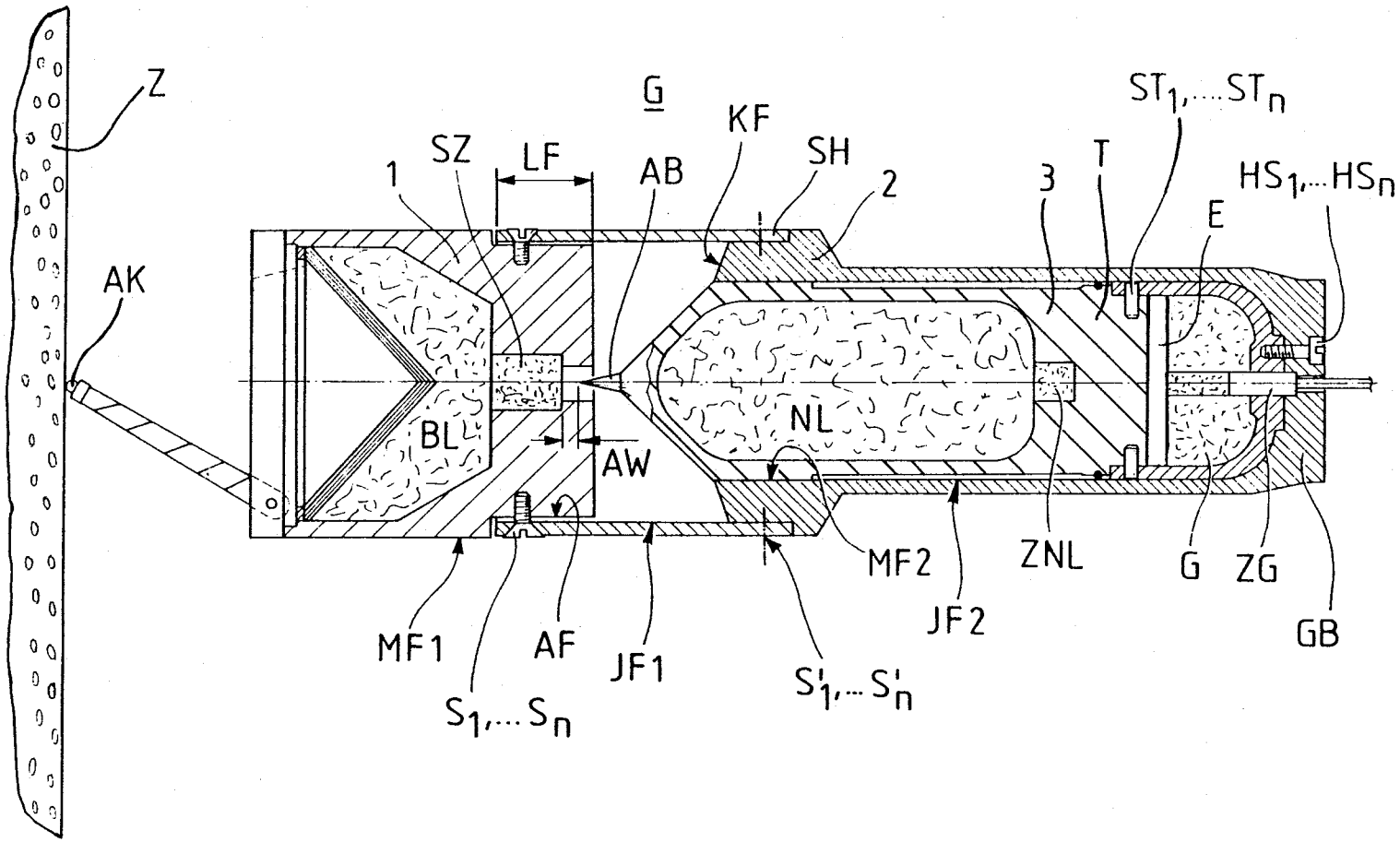
HS1,...HSn
GB
ZG
G
E
ST1,...STn
T
3
ZNL
JF2
MF2
2
SH
NL
S'1,...S'n
KF
G
AB
AW
JF1
LF
AF
SZ
S1,...Sn
1
BL
MF1
Z
AK

TANDEM CHARGE PROJECTILE

BACKGROUND OF THE INVENTION

The present invention relates to a projectile having a tandem charge consisting of a borehole charge or shaped charge and a secondary firing charge, which projectile comprises a tubular housing in which the secondary firing charge provided with a propellant charge is stored.

German Pat. No. 18 11 331 describes a projectile with a tandem charge in which the secondary firing charge is stored in a tubular shaft behind the shaped charge. The secondary firing charge has a propellant charge which is initiated by the bottom fuse of the projectile upon impact. Firing the shaped charge by the secondary firing charge is not provided in the device disclosed in that patent, however, From DE-OS No. 27 57 806, a connecting device between two stages of an aerodynamic body with built-in propulsion drive has become known. The forward and the rear stage are arranged movably relative to each other by means of two meshing cylindrical surfaces and are held together by means of detachable fastening means. Because of the propulsion mechanism pressure of the rear stage, the fastening means are sheared off and the rear stage is pushed onto the forward stage. Guidance of the piercing bolt attached to the rear stage in the direction toward the percussion igniter fastened in the forward stage exists only in the region where the meshing cylindrical surfaces overlap.

In tandem charges, especially in take-off trajectory bombs of present design, it is known to equip the housing with a tubular guide, in which the secondary firing charge is supported with a sliding fit. Thus, the secondary firing charge will move in the guide toward the forward housing part in the event of a suitably directed acceleration force. This process is utilized for piercing a percussion fuse. However, operating failures occur again and again because no ignition could take place due to an axial offset of the piercing guide or premature breaking away of the borehole charge.

SUMMARY OF THE INVENTION

It is therefore the object of the present invention to provide a piercing guide in a tandem projectile such that malfunctioning of the ignition especially due to an offset of the piercing needle relative to the percussion fuse is prevented.

The above and other objects of the invention are achieved by a projectile with a tandem charge comprising a shaped charge and a secondary firing charge, the projectile comprising a tubular housing in which the secondary firing charge provided with a propellant charge is stored, the projectile comprising a first housing part which contains the shaped charge together with a percussion fuse arranged rearward and axially centered and which has at its rearward outer surface an outside surface with a defined guide length. The projectile further contains a second housing part with a straight or a stepped inside surface which is pushed with the forward part of the inside surface completely over the outside surface given by the guide length and is held by means of detachable fastening means and which has at its rearward end a housing bottom sealing the second housing part. The projectile contains the housing of the secondary firing charge with the igniting device belonging thereto and a propulsion reflector (cartridge-case base) which is supported with its outer surface in the inside surface of the second housing part with a sliding fit and which has as its tip a piercing bolt which is arranged axially centered and corresponds to the percussion fuse, and is fastened to the second housing part with further detachable fastening means. Finally, the projectile contains between the propulsion reflector and the housing bottom an expansion space and a gas generator which is arranged at the housing bottom and is initiated by means of an igniter started by the percussion contact.

BRIEF DESCRIPTION OF THE DRAWING

An embodiment according to the invention is shown in the sole figure of the drawing and will be described in greater detail in the following detailed description:

The FIGURE shows a longitudinal section through a tandem charge projectile.

DETAILED DESCRIPTION

The projectile basically comprises three housing parts 1, 2, 3 with the masses m1, m2, m3 which are supported movably inside each other in an at least partially form-locking manner. The forward first housing part 1 contains the shaped charge BL of the tandem projectile. Axially behind it, the corresponding pierce-sensitive igniter SZ is arranged. At its rearward end, the outer surface MF1 of the housing part 1 has a setback cylindrical outside surface AF with the length LF.

Onto this cylindrical outside surface AF, the forward end of the cup-shaped second housing part 2 is pushed with its cylindrical inside surface JF1 and fastened by means of a number of screws $S_1$ ..., Sn which can be sheared off. The housing part 2 can be designed as a stepped tube or advantageously with a sructured envelope SH, the structure envelope being fastened to the housing part 2 by means of screws $S'_1 \ldots, S'_n$, the shearing-off force of which is at least twice as large as that of the fastening means $S_1 \ldots, S_n$. In its rearward part, it has a further cylindrical inside surface JF2, in which the housing 3 of the secondary firing charge NL is movably supported with its cylindrical outside surface MF2.

The secondary firing charge NL is fastened in the region of its propulsion reflector T by means of shear pins $ST_1 \ldots ST_n$ to the gas generator G, leaving an expansion space E free. The gas generator itself is bolted with its form-locking housing to the housing body GB by mounting screws $HS_1 \ldots, HS_n$.

The third housing part 3 finally contains the secondary firing charge NL of the tandem projectile and the corresponding fuse ZNL. A piercing bolt AB is fastened, axially centered, to the tip of the third housing part; it is aligned accurately centered with the piercing-sensitive igniter SZ.

The piercing process proceeds as described in the following:

When the projectile G strikes a target Z, the inpact igniter AK mounted in the tip of the projectile, for instance, a proximity fuse of known design, triggers the gas generator G. The gas pressure generated by the same escapes suddenly into the expansion space E and acts on the mutually opposite end faces of the propulsion reflector T and the housing bottom GB with pressure. Thereby, the shear pins $ST_1 \ldots, ST_n$ and simultaneously the screws $S_1 \ldots, S_n$ are sheared off and the oppositely-directed motion process from the second housing part 2 and the secondary firing charge NL begins.

The second housing part 2 is guided on the cylindrical outside surface AF of the first housing part and itself guides the third housing part 3 along the second cylindrical inside surface JF2. The length LF of the piercing guide necessary for operation through the second housing part 2 to the housing part 1 equipped with the impact fuse is calculated, depending on the piercing travel AW required for operation as a function of the housing masses m2 and m3 of the second and third housing part 2, 3 and an arbitrarily selectable safety factor S as:

$$LF=(m3/m2)\times AW\times S.$$

By the masses which are moving freely relative to each other, an axially centered guidance is assured at any time during the piercing process.

The special advantage of the invention is seen in the fact that with such a design of a tandem charge, exact piercing guidance is always assured due to the countermoving mass motion, independently of the conditions under which a target is struck.

In the foregoing specification, the invention has been described with reference to an exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A projectile having a tandem charge comprising a shaped charge and a secondary firing charge, the projectile comprising a tubular housing, the secondary firing charge and a propellant charge being stored in a part of the tubular housing, the tubular housing comprising:

a first housing part containing the shaped charge and a percussion igniter arranged toward the rear thereof and axially centered and further having at a rearward outside surface thereof an outer surface with a defined guide length;

a second housing part having an inside surface which is slipped with a forward part of the inside surface onto the outside surface of the first housing part defined by the guide length and being held by first detachable shearable fastening means thereto and having at a rear end thereof a housing bottom sealing the second housing part;

a third housing part containing the secondary firing charge, a firing device therefor and a propulsion reflector which is supported with an outer surface thereof with a sliding fit in a rearward part of the inside surface of the second housing part and having a tip having a piercing bolt which is arranged axially centered and adjacent the percussion igniter and being fastened to the second housing part with second detachable shearable fastening means;

the projectile further having an expansion space and a gas generator arranged at a bottom of the third housing part adjacent the bottom of the second housing part, the gas generator being initiated by an igniter started by a percussion contact, said expansion space being arranged between the propulsion reflector and the gas generator;

said gas generator, upon or in proximity to impact of the projectile on a target, generating pressurized gas to cause said first and second detachable shearable fastening means to shear upon impact, whereby said second housing part moves in a direction opposite the direction of motion of the projectile upon impact, said second housing part being guided on said defined guide length in a defined direction opposite that of the direction of the projectile upon impact, and said third housing part being guided on the inside surface of the second housing part in a direction opposite that of the second housing part thereby allowing said secondary firing charge to impact upon said percussion igniter thereby to ignite said shaped charge.

2. The projectile recited in claim 1 wherein said second housing part comprises a tubular housing part attached to said first housing part with said first detachable shearable fastening means and a further tubular housing part having said rearward part of the inside surface for supporting slidably said third housing part, said tubular housing part and further tubular housing part being fastened together by third detachable shearable fastening means;

said third detachable shearable fastening means being shearable by a force which is at least twice as large as that required to shear said first and second detachable shearable fastening means.

* * * * *

UNITED STATES PATENT AND TRADEMARK OFFICE

CERTIFICATE OF CORRECTION

PATENT NO. : 4,803,928

DATED : Feb. 14, 1989

INVENTOR(S) : Stefan Kramer, et al

It is certified that error appears in the above-identified patent and that said Letters Patent is hereby corrected as shown below:

On the title page:

--Assignee: Messerschmitt-Bolkow-Blohm GMBH,
The Federal Republic of Germany--

Signed and Sealed this

Thirty-first Day of July, 1990

*Attest:*

HARRY F. MANBECK, JR.

*Attesting Officer*

*Commissioner of Patents and Trademarks*